US009208969B2

(12) United States Patent
Berger

(10) Patent No.: US 9,208,969 B2
(45) Date of Patent: Dec. 8, 2015

(54) THREE TERMINAL DISPENSING SWITCH IN AN APPLIANCE

(71) Applicant: General Electric Company, Schenectady, NY (US)

(72) Inventor: Justin Daniel Berger, Louisville, KY (US)

(73) Assignee: General Electric Company, Schenectady, NY (US)

( * ) Notice: Subject to any disclaimer, the term of this patent is extended or adjusted under 35 U.S.C. 154(b) by 131 days.

(21) Appl. No.: 13/719,423

(22) Filed: Dec. 19, 2012

(65) Prior Publication Data

US 2014/0166692 A1 Jun. 19, 2014

(51) Int. Cl.
*B67B 7/00* (2006.01)
*H01H 13/38* (2006.01)

(52) U.S. Cl.
CPC ..... *H01H 13/38* (2013.01); *Y10T 307/74* (2015.04)

(58) Field of Classification Search
CPC ..... H02J 4/00; H01H 1/00; H01H 13/38; F25C 5/00; Y10T 307/74
USPC ..... 222/1, 129, 144.5, 146.6; 200/52 R, 200/61.86, 520, 532, 537, 239; 62/331, 62/344, 338, 389; 307/112
See application file for complete search history.

(56) References Cited

U.S. PATENT DOCUMENTS

| | | | | |
|---|---|---|---|---|
| 3,638,392 | A | 2/1972 | Welker, Jr. et al. | |
| 4,050,046 | A * | 9/1977 | Wilson | 337/319 |
| 4,209,999 | A | 7/1980 | Falk et al. | |
| 4,846,381 | A | 7/1989 | Kito et al. | |
| 4,851,662 | A | 7/1989 | Ott et al. | |
| 5,474,213 | A * | 12/1995 | Unger | 222/108 |
| 5,886,430 | A * | 3/1999 | Ralson et al. | 307/126 |
| 7,188,487 | B2 * | 3/2007 | Choi | 62/389 |
| 7,501,594 | B2 | 3/2009 | Fulton et al. | |
| 7,814,762 | B2 * | 10/2010 | Kavchale et al. | 62/344 |
| 8,008,586 | B2 * | 8/2011 | Kuehl et al. | 200/51 R |
| 8,132,586 | B2 * | 3/2012 | Schindler | 137/1 |
| 2005/0012504 | A1 | 1/2005 | Draggie et al. | |
| 2007/0023451 | A1 | 2/2007 | Bordino | |
| 2010/0044391 | A1 | 2/2010 | Fallon et al. | |

OTHER PUBLICATIONS

RepairClinic.com, http://www.repairclinic.com/PartDetail/Micro-Switch/2162361/445177, Dated May 28, 2012 by Wayback Machine.*

Electrolux Home Products, Frigidaire Factory Parts Catalog, Published on Oct. 3, 2003.*

* cited by examiner

*Primary Examiner* — Nicholas J Weiss
(74) *Attorney, Agent, or Firm* — Dority & Manning, P.A.

(57) ABSTRACT

A dispensing switch in an appliance and a method of controlling a dispensing assembly based on a plurality of outputs of the dispensing switch is provided. A dispensing assembly can dispense ice cubes and/or water from the appliance when the dispensing switch is actuated. The dispensing switch can have a plurality of outputs. For instance, the dispensing switch can provide outputs through a common terminal, a normally open terminal, and a normally closed terminal. When the dispensing switch is actuated, a controller can monitor the plurality of terminals to determine whether a change in the outputs has occurred. After the controller determines that a change in the outputs of the dispensing switch has occurred, the controller can control the dispensing assembly based on the outputs of the dispensing switch.

5 Claims, 6 Drawing Sheets

THREE TERMINAL DISPENSING SWITCH IN AN APPLIANCE

FIELD OF THE INVENTION

The present disclosure relates to a dispensing assembly in an appliance and more particularly to an improved method of detecting a dispensing request in an appliance.

BACKGROUND OF THE INVENTION

An appliance, such as a refrigerator, can include an icemaker to provide ice cubes and a water dispenser to provide water upon request. Generally, the icemaker and water dispenser assemblies are disposed in a compartment inside the refrigerator. After receiving a request from a user, ice cubes and/or water can be dispensed through an opening in the door of the refrigerator.

A dispensing switch can be coupled to a device that receives the user's request for ice cubes and/or water, such as a paddle. Conventionally, the dispensing switch is a direct current completing switch located remotely from the paddle, making it susceptible to stack up and tolerance issues. This configuration increases the complexity of the device and the manufacturing process while also increasing the cost.

In another conventional approach, when a direct current dispensing switch is located in close proximity to the dispensing location, premature malfunction of the switch can be caused due to cut wires, invasive moisture, and/or corrosion. Premature malfunction can cause undesired dispensing of ice cubes and/or water.

Thus, a need exists for an improved dispensing control system for an appliance.

BRIEF DESCRIPTION OF THE INVENTION

Aspects and advantages of the invention will be set forth in part in the following description, or may be apparent from the description, or may be learned through practice of the invention.

One exemplary aspect of the present disclosure is directed to an appliance. The appliance can include a dispensing assembly configured to dispense ice cubes or water from the dispensing assembly. The appliance can further include a three-terminal dispensing switch having first terminal, a common terminal, and a second terminal. The dispensing switch is configured to be actuated to dispense ice cubes or water from the dispensing assembly. The appliance further includes a controller coupled to the three-terminal dispensing switch. The controller is configured to monitor the output of the first terminal and the second terminal and control the dispensing assembly to dispense ice cubes or water upon detecting a change in both the output of the first terminal and the output of the second terminal.

Another exemplary aspect of the present disclosure is directed to a method of dispensing ice cubes or water from a dispensing assembly. The method includes receiving a first signal indicative of a first output of a first terminal of a three-terminal dispensing switch; receiving a second signal indicative of a second output of a second terminal of a three-terminal dispensing switch; determining a change in both the first output and the second output of the dispensing switch; and controlling the dispensing assembly to dispense ice cubes or water based on the change in both the first output and the second output of the dispensing switch.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
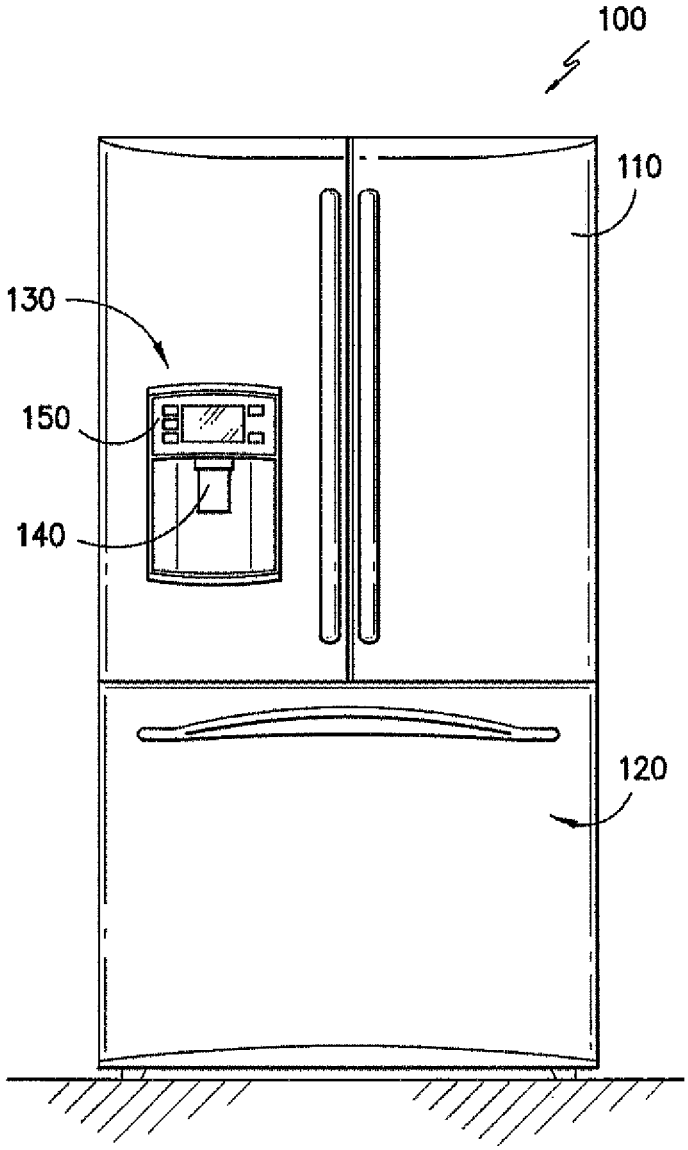
FIG. 1 depicts a front view of an exemplary refrigerator appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure relates to a dispensing switch in an appliance and a method of controlling a dispensing assembly based on a plurality of outputs of the dispensing switch. A dispensing assembly can dispense ice cubes and/or water from the appliance when the dispensing switch is actuated. The dispensing switch can be a three-terminal switch. For instance, the dispensing switch can provide outputs through a common terminal, a normally open terminal, and a normally closed terminal. When the dispensing switch is actuated, a controller can monitor the plurality of terminals to determine whether a change in the outputs has occurred. After the controller determines that a change in the outputs of the dispensing switch has occurred, the controller can control the dispensing assembly based on the outputs of the dispensing switch. In this way, the controller can verify that both outputs have changed before controlling the dispensing assembly to dispense ice or water.

According to aspects of the present invention, monitoring a plurality of outputs of a dispensing switch can provide improved dispensing performance. When the outputs of the normally open terminal and the normally closed terminal are both indicative of a request to dispense, premature and/or undesired dispensing of ice cubes and/or water can be prevented. The complexity and cost of the device and the manufacturing process can also be reduced. In particular, the three-terminal switch can be a low voltage signal switch (lower cost) rather than direct circuit completing switch. The switch can be integrated in close proximity behind the paddle, reducing stackup and tolerance issues as well as excess material costs. The switch can be simply moisture shielded with low cost plastic ribs rather than integrating costly sealed switches. Finally, the use of the three-terminal switch according to aspects of the present disclosure can provide a dispensing switch design that is more robust against moisture, corrosion, and cut wires.

FIG. 1 illustrates an exemplary refrigerator 100 according to an exemplary embodiment of the present disclosure. While the present disclosure will be discussed with reference to a dispensing switch used in a refrigerator for purposes of illustration and discussion, those of ordinary skill in the art, using the disclosures provided herein, will understand that the present subject matter is equally applicable to other appliances including switching devices.

As illustrated in FIG. 1, refrigerator 100 can include a fresh food compartment 110, a freezer compartment 120, and a dispensing assembly 130. The dispensing assembly can include a dispensing paddle 140, a dispensing assembly control panel 150, an icemaker assembly (not shown), and a water dispensing assembly (not shown).

The dispensing assembly 130 can be disposed within a door of the refrigerator 100 and can dispense ice from the icemaker assembly and water from the water dispensing assembly through the door in the refrigerator. The dispensing assembly control panel 150 can include input devices for a user to select various dispensing options such as ice cube size or water temperature. For instance, the dispensing assembly control panel 150 can include a display, buttons, toggles, switches, etc.

The dispensing paddle 140 can be coupled to a controller (not shown) such that when a user initiates contact with the paddle, ice cubes or water can be dispensed to the user from the refrigerator 100. The dispensing paddle 140 can include a dispensing switch. The dispensing switch can provide a plurality of outputs to the controller indicative of the actuation state of the switch.

Figure 2:
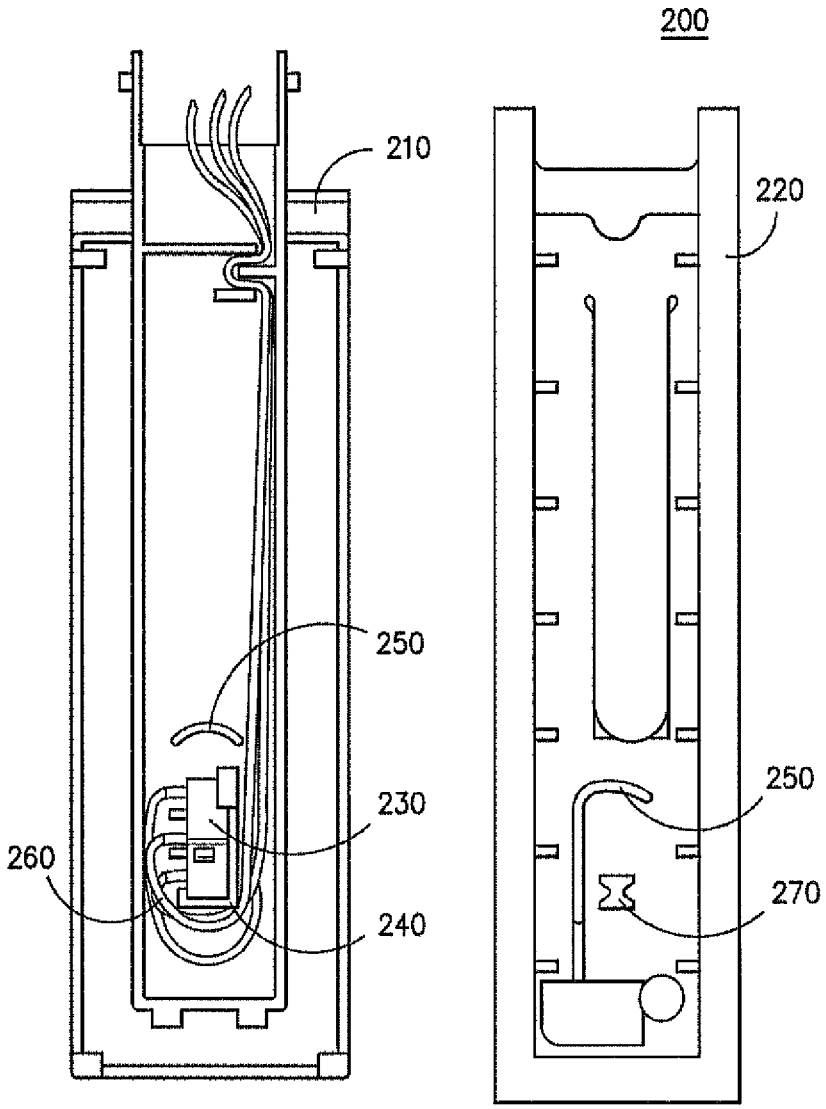
FIG. 2 depicts an exploded view of an exemplary paddle of a refrigerator appliance according to an exemplary embodiment of the present disclosure.
Figure 3:
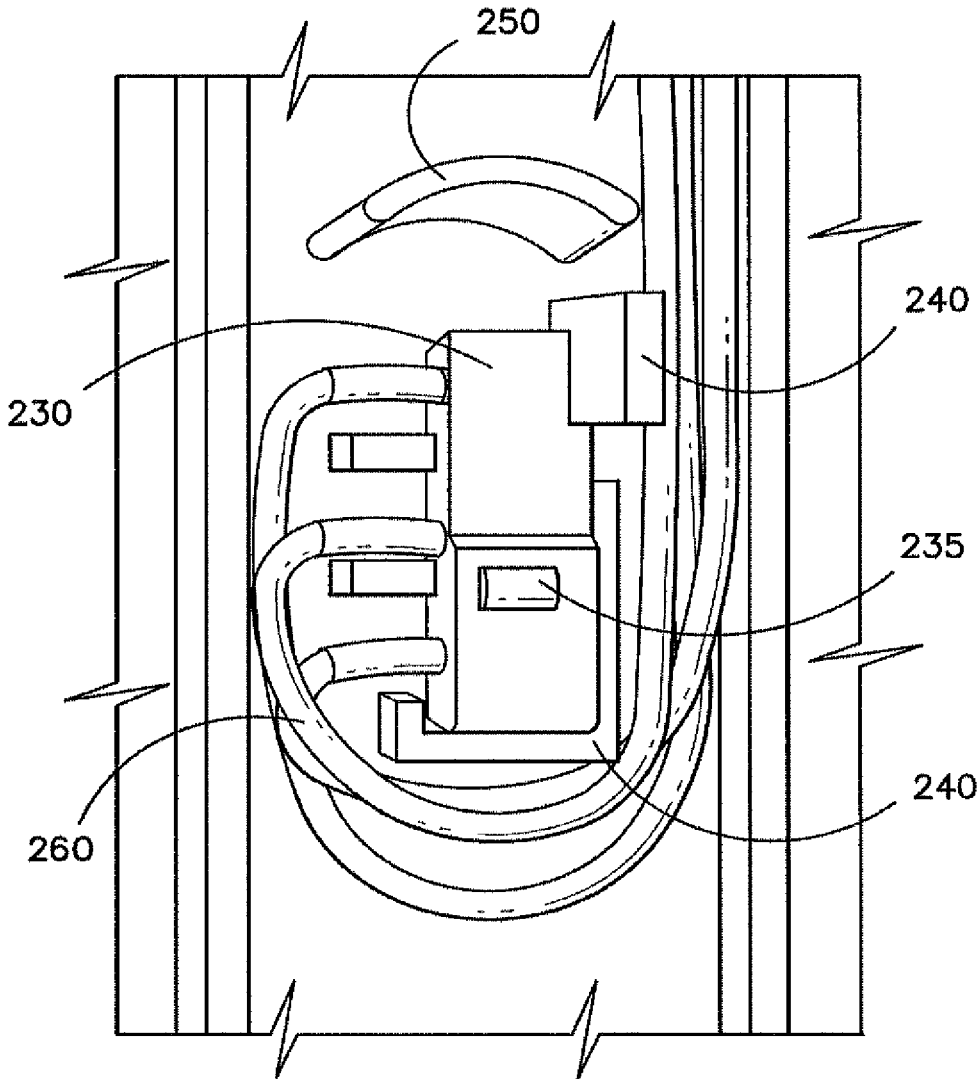
FIG. 3 depicts a magnified perspective view of an exemplary dispensing switch mounted in an exemplary paddle according to an exemplary embodiment of the present disclosure.

FIGS. 2 and 3 illustrate an exemplary dispensing paddle assembly 200 according to an exemplary embodiment of the present disclosure. FIG. 2 illustrates the assembly 200 and FIG. 3 illustrates a magnified portion of the assembly 200. As illustrated in FIGS. 2 and 3, the dispensing paddle assembly 200 includes a dispensing paddle 210 and a paddle housing 220. The dispensing switch 230 can be coupled to the switch mount 240 and can include a dispensing switch contact button 235. A moisture shield 250 can be provided on the dispensing paddle 210 and/or the paddle housing 220 to prevent moisture from entering the dispensing switch 230. Outputs of the dispensing switch 230 can be coupled to the controller through wires 260. When a user actuates the paddle 210, dispensing switch contact button 235 contacts the switch button contact standoff 270 actuating the switch 230. Outputs from the switch can be communicated to the controller such that the controller controls the dispensing assembly based on the actuation of the switch 230.

Figure 4:
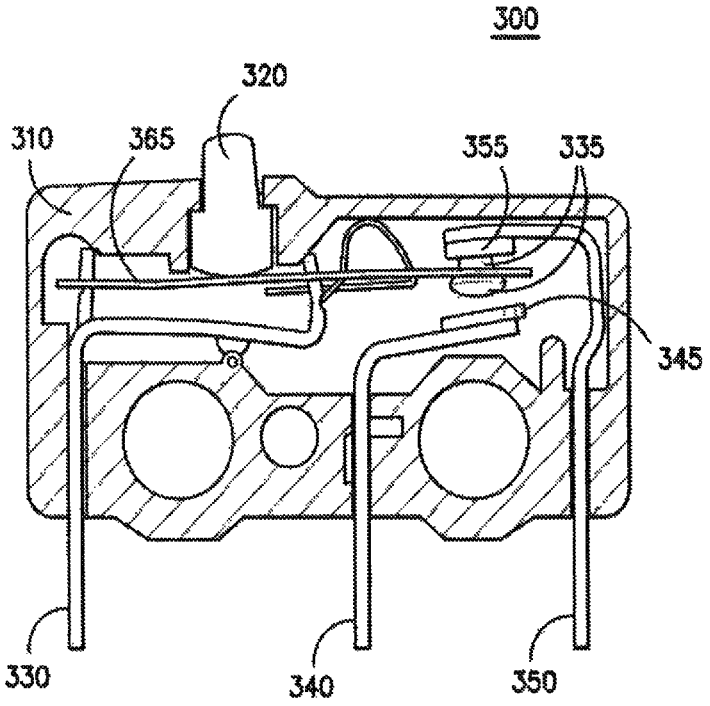
FIG. 4 depicts a cross-sectional view of an exemplary dispensing switch according to an exemplary embodiment of the present disclosure.

FIG. 4 illustrates an exemplary dispensing switch 300 according to an exemplary embodiment of the present disclosure. The dispensing switch 300 can include, a switch housing 310, a dispensing switch contact button 320, a common terminal 330, a normally open terminal 340, and a normally closed terminal 350.

Dispensing switch 300 can be a microswitch that can conduct a current through the switch based on the actuation of the switch. When the switch is not actuated, an electrical contact 335 of the common terminal 330 is in communication with an electrical contact 355 of the normally closed terminal 350 and is not in communication with an electrical contact 345 of the normally open terminal 340. In this state, the normally open terminal 340 provides an output indicative of an open circuit and the normally closed terminal 350 provides a signal indicative of a normally closed circuit.

When the switch 300 is actuated, for instance, when a user actuates the paddle using a container, the dispensing switch contact button 320 contacts a flat spring 365 coupled to the common terminal 330. The contact causes the flat spring 365 to flex such the electrical contact 335 of the common terminal 330 disengages from contact with the electrical contact 345 of the closed terminal 350 and engages the electrical contact 345 of the open terminal 340. When electrical contact 335 of the common terminal 330 comes in contact with electrical contact 345 of the normally open terminal 340, the normally open terminal 340 circuit closes and the normally closed terminal 350 circuit opens such that the outputs are indicative of actuation of the paddle. In particular, the normally open terminal 340 provides an output indicative of a closed circuit and the normally closed terminal 350 provides an output indicative of a normally open circuit.

The outputs of the normally open terminal 340 and the normally closed terminal 350 can be monitored to detect a change in outputs that is indicative of a request for dispensing. For example, when the paddle is actuated, such as when a user actuates the paddle using a container, the output of the normally open terminal 340 will change from a signal indicative of an open circuit to a signal indicative of a normally closed circuit. In addition, the output of the normally closed terminal 350 will change from a signal indicative of a closed circuit to a single indicative of an open circuit. A controller can detect the changes in outputs of both the normally open terminal 340 and the normally closed terminal 350 and a control the dispensing assembly to induce dispensing into the container based on the changes in these outputs.

For example, when there is no request for dispensing and the outputs of the terminals 340 and 350 are in their normal state, a current can be detected at the normally closed terminal 350 and no current can be detected at the normally open terminal 340. When a request for dispensing is received by actuating the switch contact button 320, the electrical contact 335 of the common terminal. 330 can contact the electrical contact 345 of the normally open terminal 350 allowing a current to flow through the normally open terminal 340 of the switch 300 and stop the flow of current through the normally closed terminal 350 of the switch 300. This change in currents at the output of both the normally open terminal 340 and the normally closed terminal can be indicative of a request to dispense ice or water from the dispensing assembly.

After the container is sufficiently full, a user can remove the container from the paddle thereby disengaging the dispensing switch contact button 320. When the dispensing switch contact button 320 is disengaged, the flat spring 365 returns to the original position and the electrical contact 335 of the common terminal 330 can be separated from the electrical contact 345 of the normally open terminal 340 causing the circuit to open. When the flat spring 365 returns to the original position and the electrical contact 335 of the common spring terminal 330 meets the electrical contact 355 of the common spring terminal 330, the normally closed circuit is once again closed. A controller can detect the changes in the output of the normally open terminal 340, the normally closed terminal 350, or both the normally open terminal 340 and the normally closed terminal 350 and control the dispensing assembly to discontinue dispensing based on the detected changes.

Figure 5:
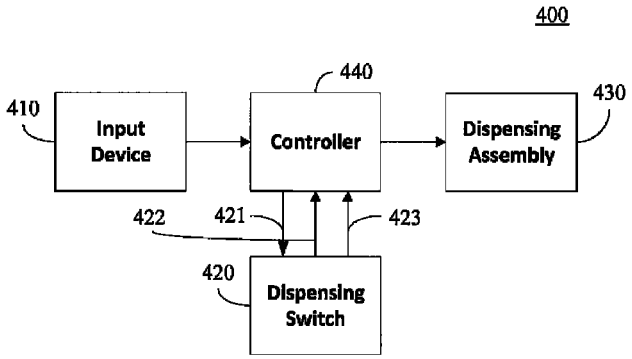
FIG. 5 depicts a block diagram of an exemplary dispensing control system according to an exemplary embodiment of the present disclosure.

FIG. 5 illustrates a block diagram of an exemplary dispensing control system 400 according to an exemplary embodiment of the present disclosure. The dispensing control system 400 can include an input device 410, a dispensing switch 420, a dispensing assembly 430, and a controller 440.

The input device 410 can receive an input from a user to select various dispensing options such as ice cube size and/or water temperature. The input device 410 can include various input and display elements such as a display, buttons, toggles, switches, etc. The controller 440 can receive a signal indicative of the user's selection from the input device 410 to determine the appropriate dispensing assembly 430 to actuate. For instance, when a user selects crushed ice on the input device 410, the controller 440 can determine that the corresponding dispensing assembly 430 is an ice cube dispensing assembly. Alternatively, when a user selects water as a desired dispensing option, the controller 440 can determine that the corresponding dispensing assembly 430 is a water dispensing assembly.

Controller 440 can determine whether the dispensing switch 420 has been actuated based on a plurality of outputs of the dispensing switch 420. The controller 440 can be a single controller or a plurality of controllers. For instance, a single controller 440 can be coupled to the normally open terminal 422 and the normally closed terminal 423 where the controller 440 determines whether there has been a change in the output of both terminals. Alternatively, a first controller, such as a dispenser control board, can be coupled to the normally open terminal 422 of the dispensing switch 420 and a second controller, such as a door control board, can be coupled to the normally closed terminal 423 of the dispensing switch 420 where each board determines whether a change in the respective output has occurred. In addition, the common terminal can also be monitored to determine current and previous states of the dispensing switch 420.

The controller 440 can be positioned in any location in the appliance. In addition, when controller 440 is a single controller it can be the only controller in the appliance such that controller 440 controls all operations of the appliance. Alternatively, when controller 440 is a single controller or a plurality of controllers, controller 440 can be a sub-controller coupled to the overall appliance controller. If controller 440 is a sub-controller, it can be located with the overall appliance controller or be separate from the overall appliance controller.

By way of example, any/all of the "controllers" discussed in this disclosure can include a memory and one or more processing devices such as microprocessors, CPUs or the like, such as general or special purpose microprocessors operable to execute programming instructions or micro-control code associated with operation of an appliance including a dispensing control system. The memory can represent random access memory such as DRAM, or read only memory such as ROM or FLASH. In one embodiment, the processor executes programming instructions stored in memory. The memory can be a separate component from the processor or can be included onboard within the processor. Alternatively, the controller might also be constructed without using a microprocessor, using a combination of discrete analog and/or digital logic circuitry (such as switches, amplifiers, integrators, comparators, flip-flops, AND gates, and the like) to perform control functionality instead of relying upon software.

In a particular embodiment of the present disclosure, after a dispensing option is selected and a dispensing switch 420 is actuated, the controller 440 can provide an input to the common terminal 421 and monitor a plurality of the outputs 422, 423 of the dispensing switch 420 to determine the state of the switch prior to dispensing. For instance, the controller 440 can monitor the output of the normally open terminal 422 and the normally closed terminal 423. When the outputs of the terminals are different than the outputs of the terminals when the dispensing switch 420 is not actuated, the controller 440 can control the dispensing assembly 430 to initiate dispensing.

The dispensing assembly 430 can be an ice cube dispensing assembly and/or a water dispensing assembly. The ice cube dispensing assembly can include any elements used in generating and/or dispensing ice cubes from an appliance. For instance, the ice cube dispensing assembly can include a water valve to provide water to an ice cube mold, a dislodging device such as a rake to dislodge ice cubes from the mold, and a duct door to separate the ice cube compartment with the outside of the appliance. The water dispensing assembly can include any elements used in dispensing water from the appliance. For example, the water dispensing assembly can include a water valve and a water filter.

The controller 440 can monitor the dispensing switch 420 to determine when it is no longer actuated. When the controller 440 determines that the switch 420 is no longer actuated, the controller 440 can control the dispensing assembly to prevent further dispensing. To determine whether the dispensing switch 420 is no longer actuated, the controller 440 can compare the current outputs of the terminals 422, 423 with the previous outputs when the dispensing switch 420 was in an actuated state. Alternatively, the controller 440 can monitor the dispensing switch 420 outputs 422, 423 and discontinue dispensing upon any change in the output states.

Figure 6:
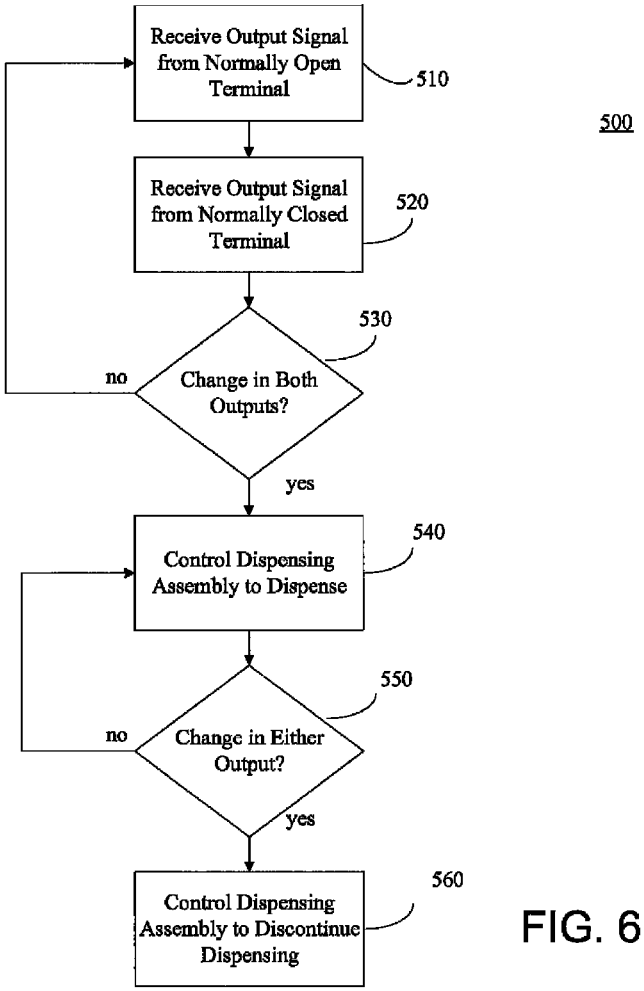
FIG. 6 depicts a flow chart of a method of controlling a dispensing control system according to an exemplary embodiment of the present disclosure.

FIG. 6 illustrates a flow chart of exemplary method 500 according to exemplary embodiments of the present disclosure. The method 500 can be implemented with any suitable appliance having a dispensing assembly. In addition, although FIG. 6 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

At (510), a controller can receive an output signal from a normally open terminal of a three-terminal switch. For instance, the controller can receive an output signal indicative of an open circuit from the normally open terminal of the three-terminal switch. At (520), the controller can receive an output signal from a normally closed terminal of a three-terminal switch. For instance, the controller can receive an output signal indicative of a closed circuit from the normally open terminal of the three-terminal switch.

At (530), the controller can determine whether there has been a change in the outputs of both the normally open terminal and the normally closed terminal of the three-terminal switch. For instance, the controller can determine whether there has been a change in the output of the normally open terminal from a signal indicative of an open circuit to a signal indicative of a closed circuit. The controller can further determine whether there has been a change in the output of the normally closed terminal from a signal indicative of a closed circuit to a signal indicative of an open circuit. If the controller detects a change in both outputs, the controller can control the dispensing assembly, for instance, to dispense ice or water (540). Otherwise, the controller can continue to receive signals from both the normally open terminal and the normally closed terminal until a change in state of both terminals is detected.

Once the controller has controlled the dispensing assembly to dispense, the controller can determine whether a change in the output of either the normally open terminal or the normally closed terminal has occurred (550). For instance, the controller can determine whether the output of the normally open terminal has changed from a signal indicative of a closed circuit back to a signal indicative of an open circuit. The controller can also determine whether the output of the normally closed terminal has changed from a signal indicative of an open circuit back to a signal indicative of a closed circuit. Upon the occurrence of either or both of these conditions, the controller can control the dispensing assembly to discontinue dispensing water or ice (560).

Although the embodiments discussed herein have been discussed with reference to a dispensing assembly for a refrigerator, those of ordinary skill in the art, using the disclosures provided herein, should understand that the present subject matter is equally applicable to other appliances, such as any appliance having a dispensing assembly, a lid or door assembly, a user input assembly, a motor assembly, or other suitable appliance. By way of example, when the three-terminal switch is used in a lid or door assembly, the switch can be used to detect the position of the door such that the appliance can be controlled based on the position of the door. For instance, in a washing machine when a lid is opened during operation, the output of the switch can be used to determine whether to discontinue operation. When the switch used in a user input assembly, the output of the switch can be indicative of a user selection. In a motor assembly, the switch can be used in conjunction with a cam and follower feedback mechanism of the motor such that the switch output can be used in rotation position detection of the motor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of dispensing ice cubes or water from a dispensing assembly, comprising:

receiving a first signal indicative of a first output of a first terminal of a three-terminal dispensing switch;

receiving a second signal indicative of a second output of a second terminal of the three-terminal dispensing switch;

determining a first change in both the first output and the second output of the dispensing switch such that the output of the first terminal and the output of the second terminal are indicative of a request to dispense;

controlling the dispensing assembly to dispense ice cubes or water based on the first change in both the first output and the second output of the dispensing switch;

determining a second change in one of the first output and the second output of the dispensing switch; and controlling the dispensing assembly to discontinue dispensing ice cubes or water based on the second change.

2. The method as in claim 1, wherein the first terminal is a normally open terminal and the second terminal is normally closed terminal.

3. The method as in claim 2, wherein determining a change in both the first output and the second output of the dispensing switch comprises determining whether the first output of the normally open terminal changes from a signal indicative of an open state to a signal indicative of a closed state; and determining whether the second output of the normally closed terminal changes from a signal indicative of a closed state to an open state.

4. The method of claim 1, wherein controlling the dispensing assembly to dispense ice cubes or water comprises sending a signal to actuate a duct door or a water valve in the dispensing assembly to initiate dispensing ice cubes or water from the dispensing assembly.

5. The method of claim 1, wherein controlling the dispensing assembly to dispense ice cubes or water further comprises determining whether to dispense water or ice cubes based at least in part on a user input selected on an input device.

* * * * *